US009010675B2

(12) United States Patent
Harrison

(10) Patent No.: US 9,010,675 B2
(45) Date of Patent: Apr. 21, 2015

(54) LENGTH-ADJUSTABLE WRAP FILM DISPENSER

(76) Inventor: Huang Harrison, Taichung (TW)

( * ) Notice: Subject to any disclaimer, the term of this patent is extended or adjusted under 35 U.S.C. 154(b) by 223 days.

(21) Appl. No.: 13/571,970

(22) Filed: Aug. 10, 2012

(65) Prior Publication Data

US 2013/0227913 A1 Sep. 5, 2013

(30) Foreign Application Priority Data

Mar. 1, 2012 (TW) ..... 101203655 U

(51) Int. Cl.
*B65H 75/24* (2006.01)
*B65B 67/08* (2006.01)
*B65H 16/00* (2006.01)

(52) U.S. Cl.
CPC ..... *B65B 67/085* (2013.01); *B65H 75/241* (2013.01); *B65H 16/005* (2013.01); *B65H 2403/731* (2013.01); *B65H 2701/1944* (2013.01)

(58) Field of Classification Search
CPC ..... B65B 67/085; B65H 2403/731; B65H 2511/12
USPC ..... 242/578, 578.1, 588, 588.2, 608.5, 288
See application file for complete search history.

(56) References Cited

U.S. PATENT DOCUMENTS 1,098,479 A † 6/1914 Clark, Jr.
1,248,017 A † 11/1917 Sande
1,410,014 A † 3/1922 Hurlburt
2,406,435 A * 8/1946 Payne ..... 242/125.1
2,905,408 A * 9/1959 Stetka et al. ..... 242/578.2
3,447,759 A * 6/1969 Rau ..... 242/578.2
4,101,095 A * 7/1978 Carter ..... 242/578.1
5,322,234 A † 6/1994 Robert
5,664,739 A * 9/1997 Black et al. ..... 242/588.2
6,676,069 B1 * 1/2004 Davis ..... 242/609.1
6,892,975 B2 * 5/2005 Yu Chen ..... 242/422.4
7,210,649 B2 * 5/2007 Yu Chen ..... 242/588.2
7,552,891 B2 * 6/2009 Huang ..... 242/588.2
7,726,600 B2 * 6/2010 Huang ..... 242/588.2
7,942,364 B2 * 5/2011 Yu Chen ..... 242/578.2
2006/0237577 A1 * 10/2006 Chen ..... 242/588
2009/0084074 A1 † 4/2009 Barbery
2011/0041458 A1 * 2/2011 Yu Chen ..... 53/389.4
2011/0042504 A1 * 2/2011 Yu Chen ..... 242/578.2

* cited by examiner
† cited by third party

*Primary Examiner* — Emmanuel M Marcelo
*Assistant Examiner* — Justin Stefanon
(74) *Attorney, Agent, or Firm* — Muncy, Geissler, Olds & Lowe, P.C.

(57) ABSTRACT

A length-adjustable wrap film dispenser includes an outer tube member having a sleeve connection portion and a first engagement portion, and an inner tube member having an insertion portion axially movably and rotatably inserted into the sleeve connection portion of the outer tube member and a second engagement portion for engagement with the first engagement portion. When rotating the inner tube member relative to the outer tube member to disengage the second engagement portion from the first engagement portion, the inner tube member can be moved axially relative to the outer tube member to adjust the length of the length-adjustable wrap film dispenser. After adjustment, the inner tube member is rotated again to force the second engagement portion into engagement with the first engagement portion, locking the inner tube member and the outer tube member.

4 Claims, 7 Drawing Sheets

LENGTH-ADJUSTABLE WRAP FILM DISPENSER

BACKGROUND OF THE INVENTION

1. Field of the Invention

The present invention relates to film dispenser technology for wrapping application and more particularly, to a length-adjustable wrap film dispenser, which allows adjustment to fit different film widths.

2. Description of the Related Art

In order to increase the efficiency of product wrapping, an operator usually will use a wrap film dispenser to dispense a stretch film or a wrapping film to the product. When using a wrap film dispenser, the wrap film is attached to the shaft of the wrap film dispenser, and then the two end blocks of the wrap film dispenser are held in the user's both hands. Subject to rotation of the shaft relative to the two end blocks, the wrap film can be rapidly dispensed to the product, enabling the product to be wrapped with the dispensed wrap film.

However, the aforesaid wrap film dispenser does not allow adjustment of the length of the shaft. Every wrap film dispenser of this design is adapted for dispensing wrap films having a specific film width. For dispensing wrap films having a different film width to wrap a different kind of size of product, a different wrap film dispenser shall be used, increasing the wrapping cost and complicating the wrapping operation.

SUMMARY OF THE INVENTION

The present invention has been accomplished under the circumstances in view. It is the main object of the present invention to provide a length-adjustable wrap film dispenser, which has the characteristics of simple structure and ease of use.

To achieve this and other objects of the present invention, a length-adjustable wrap film dispenser comprises an outer tube member and an inner tube member. The outer tube member comprises a sleeve connection portion, a first bearing portion and a first engagement portion. The sleeve connection portion defines a circular through hole axially extending through two opposite ends thereof. The first bearing portion extends axially outwardly and expands gradually outwardly from one end of the sleeve connection portion. The first engagement portion is formed on the periphery of the circular through hole. The inner tube member comprises an insertion portion, a second bearing portion and a second engagement portion. The insertion portion has a polygonal cross section. The second bearing portion extends axially outwardly and expands gradually outwardly from one end of the insertion portion. The second engagement portion is formed on the periphery of the insertion portion. The insertion portion of the inner tube member is axially movably inserted into the circular through hole of the sleeve connection portion of the outer tube member, and rotatable relative to the outer tube member between an engaged position where the second engagement portion of the inner tube member is engaged with the first engagement portion of the outer tube member to prohibit relative axial displacement between the inner tube member and the outer tube member, and a disengaged position where the second engagement portion of the inner tube member is separated from the first engagement portion of the outer tube member for enabling the inner tube member to be moved axially relative to the outer tube member by an external force.

The length-adjustable wrap film dispenser further comprises two brakes. Each brake comprises a cap member and two friction pads. The cap members of the two brakes are respectively rotatably capped on the distal end of the outer tube member and the distal end of the inner tube member. The cap member of each brake comprises two spring strip portions. The two friction pads of each brake are respectively attached to the spring strip portions. Further, each friction pad defines a friction surface. The friction pads of the brakes are respectively pressable by an external force to force the respective friction surfaces against a friction portion at the outer tube member and a friction portion at the inner tube member, stopping the outer tube member and the inner tube member from rotation. Thus, the user can control the braking force of the brakes subject to actual conditions, properly adjusting the tension of the wrap film to enhance wrapping convenience.

Other advantages and features of the present invention will be fully understood by reference to the following specification in conjunction with the accompanying drawings, in which like reference signs denote like components of structure.

DETAILED DESCRIPTION OF THE INVENTION

Figure 1:
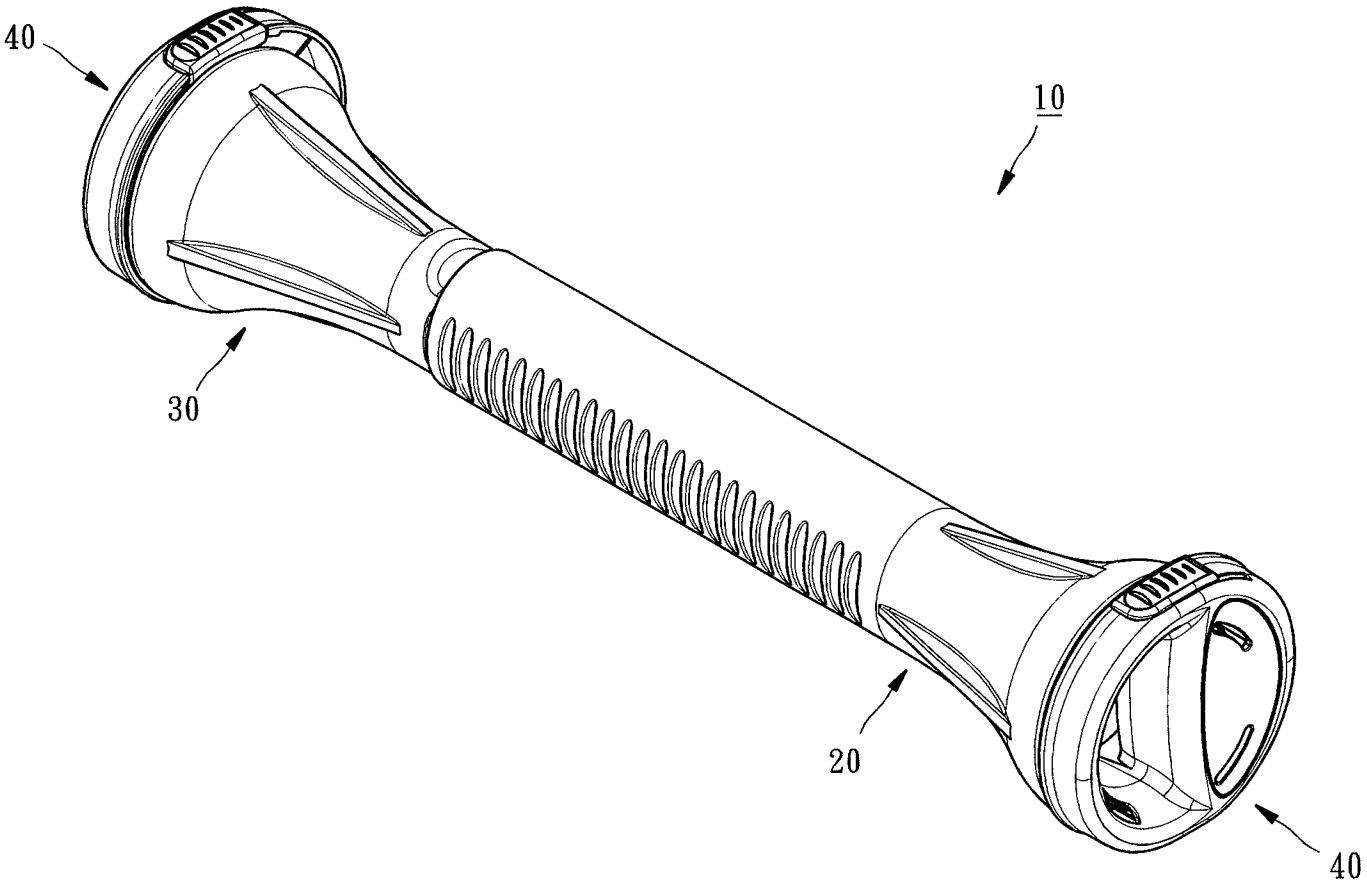
FIG. 1 is an elevational assembly view of a length-adjustable wrap film dispenser in accordance with the present invention.
Figure 2:
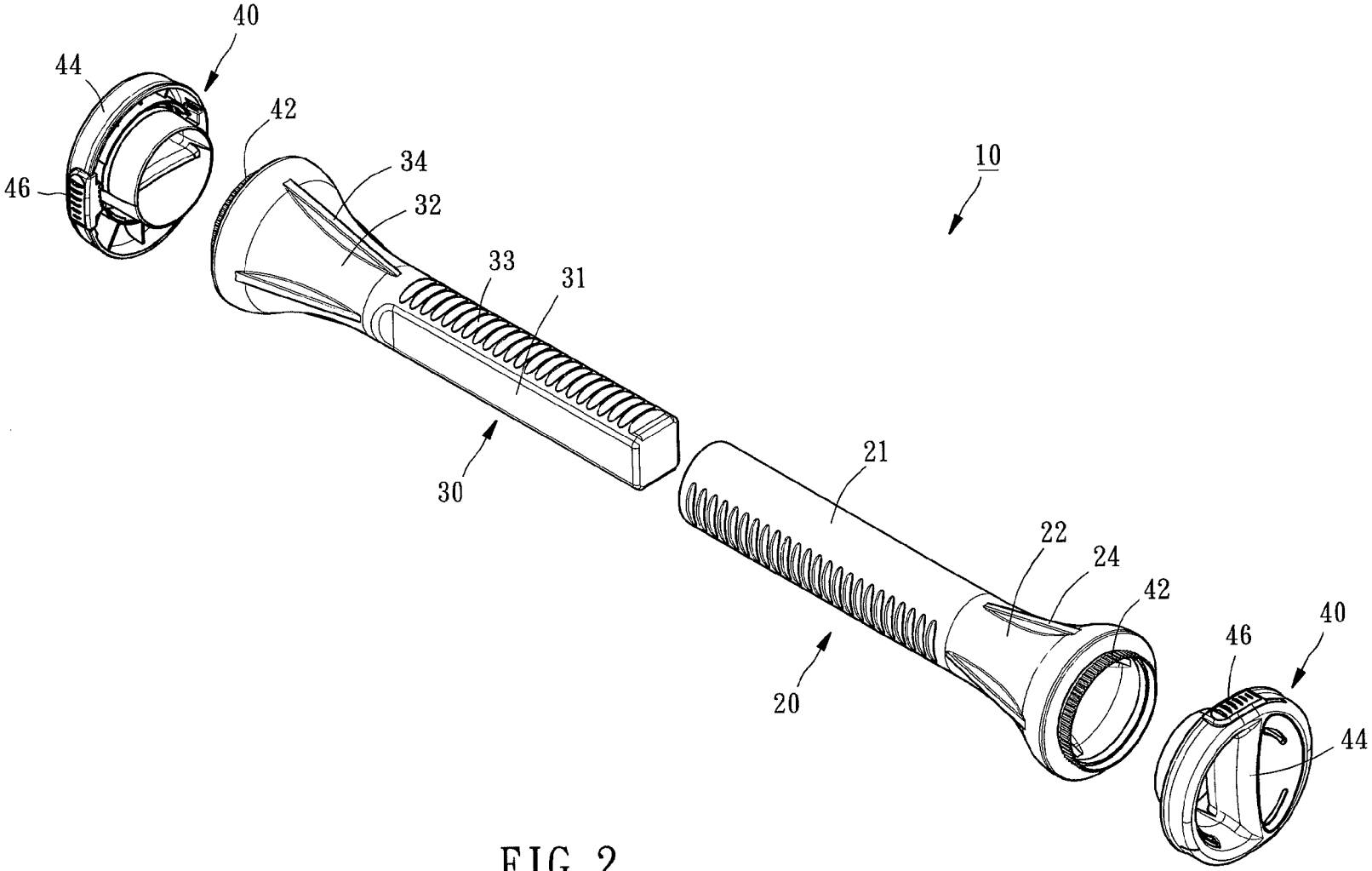
FIG. 2 is an exploded view of the length-adjustable wrap film dispenser in accordance with the present invention.

Referring to FIGS. 1 and 2, a length-adjustable wrap film dispenser 10 in accordance with the present invention is shown. The length-adjustable wrap film dispenser 10 comprises an outer tube member 20, and an inner tube member 30.

Figure 3:
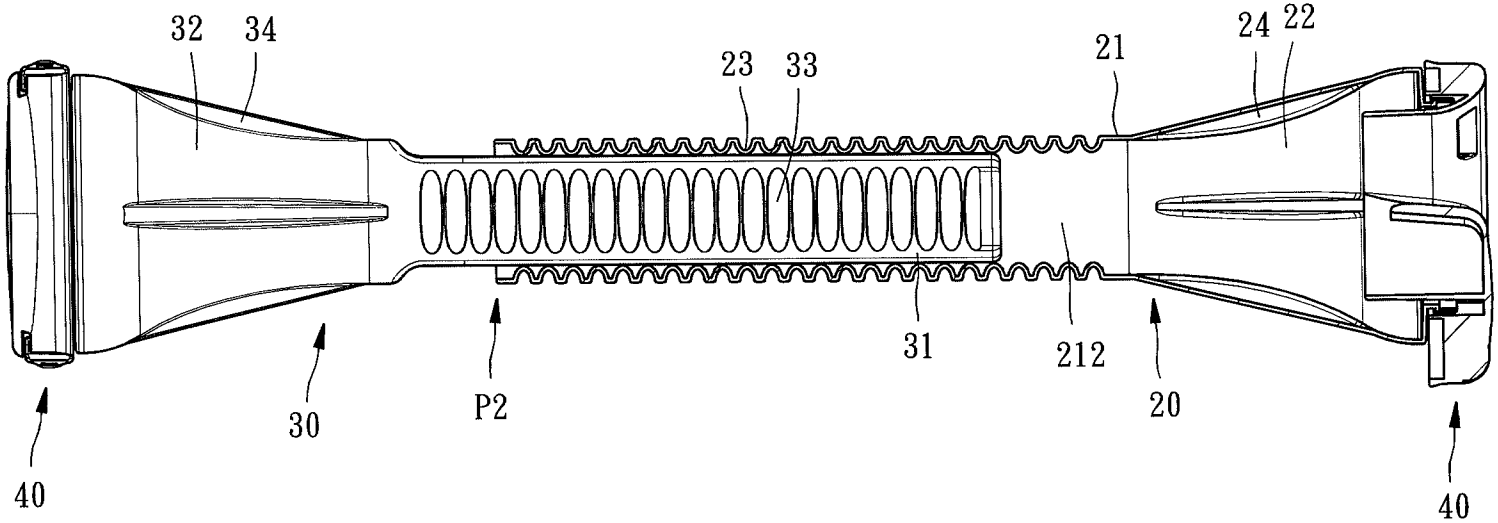
FIG. 3 is a longitudinal sectional view of the length-adjustable wrap film dispenser in accordance with the present invention, illustrating the inner tube member in the disengaged position.

The outer tube member 20 comprises a sleeve connection portion 21, a first bearing portion 22, and a first engagement portion 23. The sleeve connection portion 21 defines a circular through hole 212 axially extending through two opposite ends thereof, as shown in FIG. 3. The first bearing portion 22 extends axially outwardly and expands gradually outwardly from one end of the sleeve connection portion 21, having a plurality of first longitudinal ribs 24 spaced around the periphery thereof. The first engagement portion 23 in this embodiment is formed of a plurality of blocks that protrude outwardly relative to the peripheral wall of the circular through hole 212 and spaced along the length of the outer tube member 20 at a predetermined pitch, as shown in FIG. 3.

The inner tube member 30 comprises an insertion portion 31, a second bearing portion 32, and a second engagement portion 33. The insertion portion 31 has a polygonal cross section, preferably, rectangular cross section. The second bearing portion 32 extends axially outwardly and expands gradually outwardly from one end of the insertion portion 31, having a plurality of second longitudinal ribs 34 spaced around the periphery thereof. The second engagement portion 33 in this embodiment is formed of a plurality of blocks that protrude from the periphery of the insertion portion 31 at two opposite sides and spaced along the length of the inner tube member 30 at a predetermined pitch.

Figure 5:
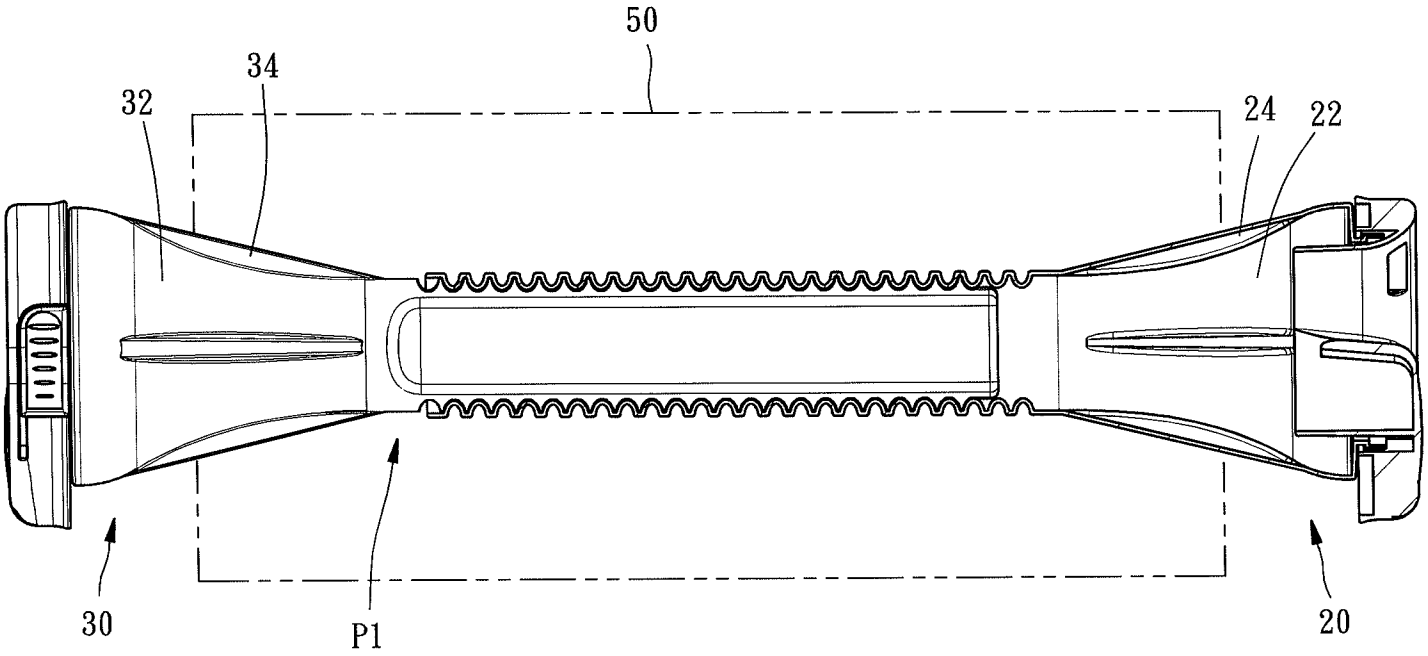
FIG. 5 is similar to FIG. 4, illustrating the inner tube member in the engaged position.

During installation, insert the insertion portion 31 of the inner tube member 30 into the circular through hole 212 of the sleeve connection portion 21 of the outer tube member 20, as shown in FIG. 3. Subject to the design of the rectangular cross section of the insertion portion 31, the inner tube member 30 can be rotated relative to the outer tube member 20 between an engaged position P1 and a disengaged position P2. When the inner tube member 30 is in the engaged position P1, as shown in FIG. 5, the second engagement portion 33 of the inner tube member 20 is engaged with the first engagement portion 23 of the outer tube member 20. On the contrary, when the inner tube member 30 is in the disengaged position P2, as shown in FIG. 3, the second engagement portion 33 of the inner tube member 20 is separated from the first engagement portion 23 of the outer tube member 20.

Figure 4:
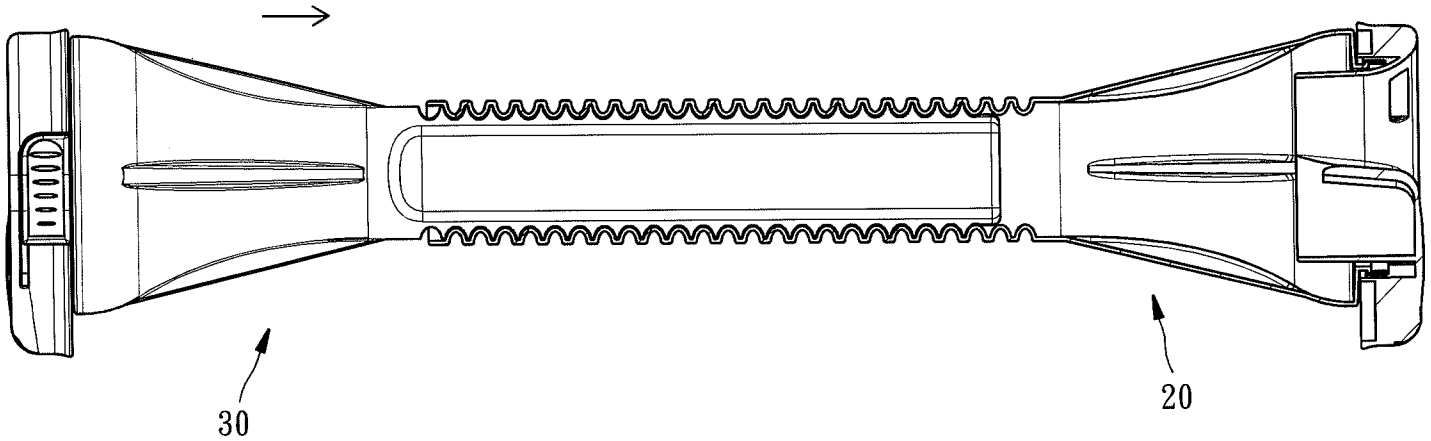
FIG. 4 is similar to FIG. 3, illustrating the inner tube member moved axially relative to the outer tube member.
Figure 6:
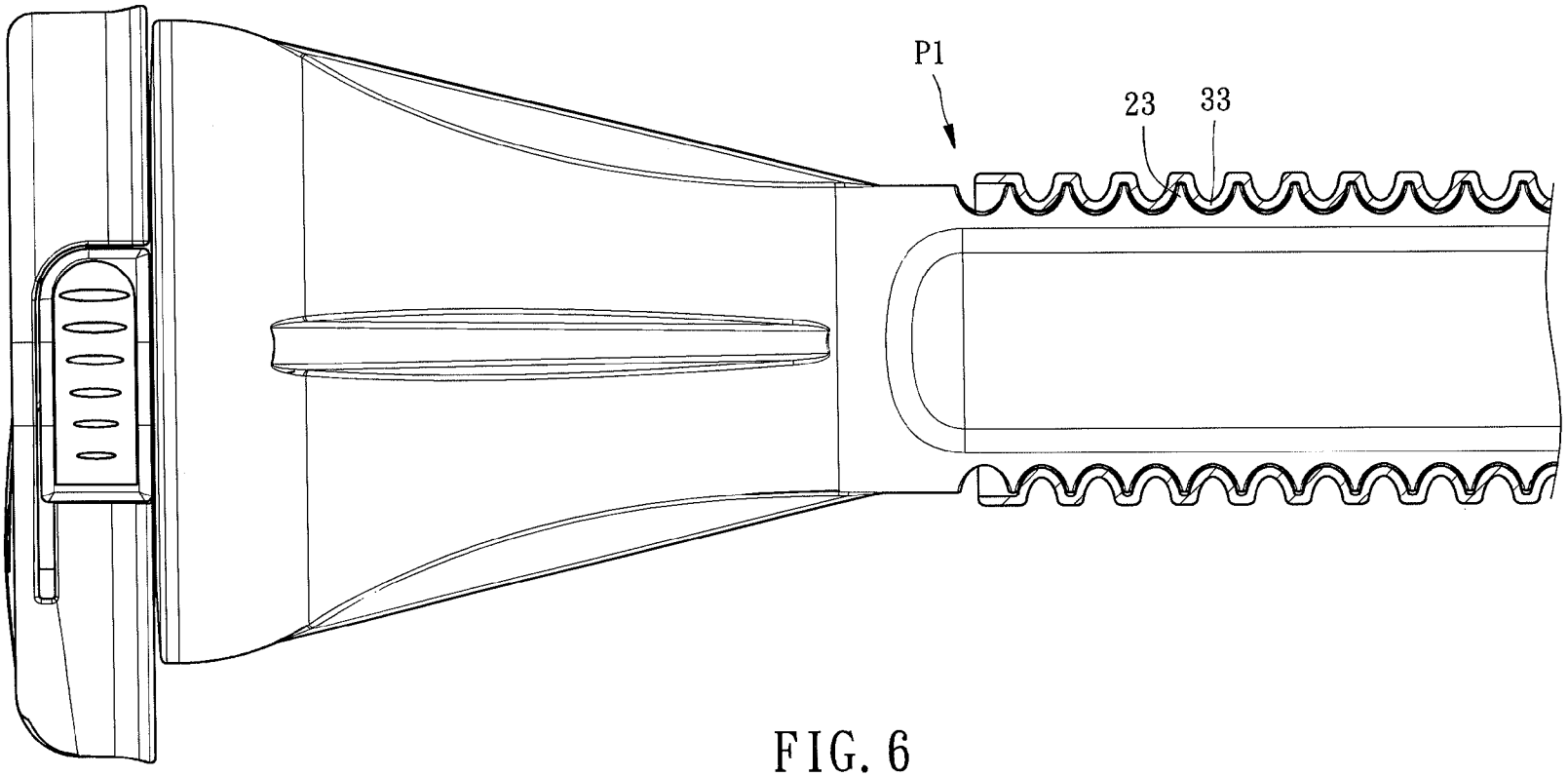
FIG. 6 is an enlarged view of a part of FIG. 5.

When going to adjust the length of the wrap film dispenser, rotate the inner tube member 30 to the disengaged position P2 to disengage the second engagement portion 33 of the inner tube member 30 from the first engagement portion 23 of the outer tube member 20, as shown in FIG. 3. At this time, the user can apply a force to the inner tube member 30 to move the inner tube member 30 axially inwardly or outwardly relative to the outer tube member 20, as shown in FIG. 4, till that the two ends of the loaded wrap film 50 can be firmly stopped by the first longitudinal ribs 24 of the first bearing portion 22 of the outer tube member 20 and the second longitudinal ribs 34 of the second bearing portion 32 of the inner tube member 30 for synchronous rotation with the outer tube member 20 and the inner tube member 30. Thereafter, rotate the inner tube member 30 to the engaged position P1 to force the second engagement portion 33 of the inner tube member 30 into engagement with the first engagement portion 23 of the outer tube member 20, as shown in FIGS. 5 and 6, prohibiting the inner tube member 30 from axial displacement relative to the outer tube member 20.

Further, for enabling the wrap film 50 to be properly stretched during dispensing, the length-adjustable wrap film dispenser 10 of the invention provides two brakes 40, and a friction portion 42 respectively disposed at the end edge of the first bearing portion 22 of the outer tube member 20 and the end edge of the second bearing portion 32 of the inner tube member 30.

Figure 7:
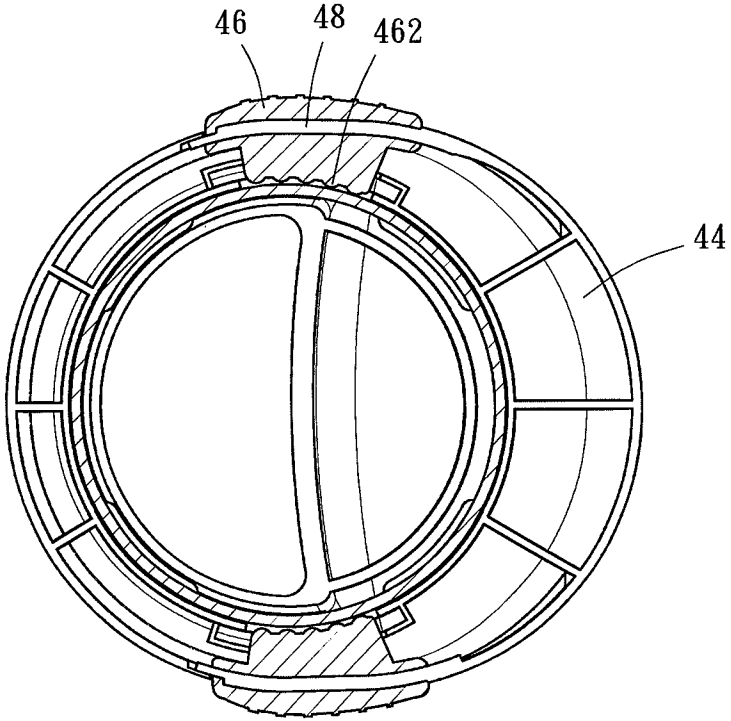
FIG. 7 is a sectional view of one brake of the length-adjustable wrap film dispenser in accordance with the present invention, illustrating the status of the friction pad before pressing.

Each brake 40 comprises a cap member 44, and two friction pads 46, as shown in FIG. 2. The cap members 44 of the two brakes 40 are respectively rotatably capped on the distal end of the outer tube member 20 and the distal end of the inner tube member 30. The cap member 44 of each brake 40 comprises two spring strip portions 48, as shown in FIG. 7, and the two friction pads 46 of each brake 40 are respectively attached to the spring strip portions 48 Further, each friction pad 46 defines a friction surface 462.

Figure 8:
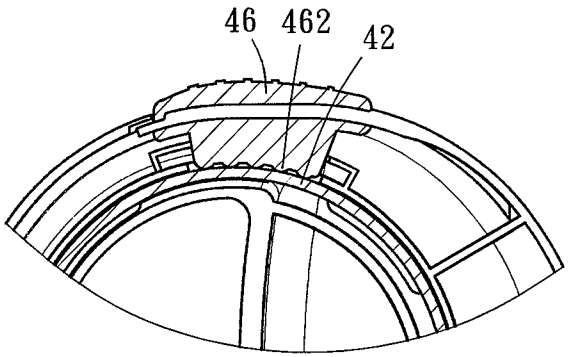
FIG. 8 is a sectional view of a part of one brake of the length-adjustable wrap film dispenser in accordance with the present invention, illustrating the status of the friction pad when pressed.

During application, the user can hold the two brakes 40 with the two hands, enabling the outer tube member 20 and the inner tube member 30 to be simultaneously rotated relative to the two brakes 40 to dispense the wrap film 50 to the product. When wrapping the product, the user can properly press the thumbs on the friction pad 46 to curve the respective spring strip portions 48 of the cap members 44 of the brakes 40 and to force the respective friction surfaces 462 against the friction portions 42 of the outer tube member 20 and the inner tube member 30, as shown in FIG. 8, causing the outer tube member 20 and the inner tube member 30 to create a brake effect on the wrap film 50, and thus the wrap film 50 is properly stretched, facilitating wrapping.

In conclusion, the length-adjustable wrap film dispenser 10 of the invention is adjustable to fit different wrap films having different film widths. In addition to the feature of simple structure, the length-adjustable wrap film dispenser 10 of the invention is convenient to use. Further, during a wrapping application, the user can control the braking force of the brakes 40 subject to actual conditions, properly adjusting the tension of the wrap film 50 to enhance wrapping convenience.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A length adjustable wrap film dispenser, comprising:

an outer tube member comprising a sleeve connection portion, a first bearing portion and a first engagement portion, said sleeve connection portion defining a through hole axially extending through two opposite ends thereof, said first bearing portion extending axially outwardly and expanding gradually outwardly from one end of said sleeve connection portion, said first engagement portion being formed on the periphery of said through hole; and an inner tube member comprising an insertion portion, a second bearing portion and a second engagement portion, said insertion portion having a polygonal cross section, said second bearing portion extending axially outwardly and expanding gradually outwardly from one end of said insertion portion, said second engagement portion being formed on the periphery of said insertion portion;

wherein said insertion portion of said inner tube member is axially movably inserted into the through hole of said sleeve connection portion of said outer tube member, and rotatable relative to said outer tube member between an engaged position where said second engagement portion of said inner tube member is engaged with said first engagement portion of said outer tube member to prohibit relative axial displacement between said inner tube member and said outer tube member, and a disengaged position where said second engagement portion of said inner tube member is separated from said first engagement portion of said outer tube member for enabling said inner tube member to be moved axially relative to said outer tube member by an external force;

wherein said first engagement portion of said outer tube member is axially formed of a plurality of blocks protruding outwardly relative to the periphery of said through hole and spaced along the length of said outer tube member at a predetermined pitch; said second engagement portion of said inner tube member is axially formed of a plurality of blocks protruding from the periphery of said insertion portion and spaced along the length of said inner tube member at a predetermined pitch;

wherein said engagement portion of said inner tube member includes a flat surface axially extending along said inner tube member and beside said blocks.

2. The length adjustable wrap film dispenser as claimed in claim 1, wherein said outer tube member further comprises a plurality of longitudinal ribs located on and spaced around the periphery of said first bearing portion.

3. The length adjustable wrap film dispenser as claimed in claim 1, wherein said inner tube member further comprises a plurality of longitudinal ribs located on and spaced around the periphery of said second bearing portion.

4. The length adjustable wrap film dispenser as claimed in claim 1, further comprising two brakes, each said brake comprising a cap member and two friction pads, the cap members of said two brakes being respectively rotatably capped on respective distal ends of said outer tube member and said inner tube member, the cap member of each said brake comprising two spring strip portions, the two friction pads of each said brake being respectively attached to the spring strip portions of the respective brake, each said friction pad defining a friction surface, wherein said outer tube member further comprises a friction portion located on an end edge of said first bearing portion; said inner tube member further comprises a friction portion located on an end edge of said inner tube member; the friction pads of said brakes are respectively pressable by an external force to force the respective friction surfaces against the friction portion of said outer tube member and the friction portion of said inner tube member in stopping said outer tube member and said inner tube member from rotation.

* * * * *